US005199855A

United States Patent [19]

Nakajima et al.

[11] Patent Number: 5,199,855

[45] Date of Patent: Apr. 6, 1993

[54] VARIABLE CAPACITY COMPRESSOR HAVING A CAPACITY CONTROL SYSTEM USING AN ELECTROMAGNETIC VALVE

[75] Inventors: Nobuyuki Nakajima; Toshio Yamaguchi, both of Konan, Japan

[73] Assignee: Zexel Corporation, Tokyo, Japan

[21] Appl. No.: 723,470

[22] Filed: Jun. 27, 1991

[30] Foreign Application Priority Data

Sep. 27, 1990 [JP] Japan ..... 2-258667
Sep. 29, 1990 [JP] Japan ..... 2-102989[U]

[51] Int. Cl.[5] ..... F04B 49/08

[52] U.S. Cl. ..... 417/295; 251/129.07; 417/310

[58] Field of Search ..... 417/295, 310; 251/129.07

[56] References Cited

U.S. PATENT DOCUMENTS 4,790,351 12/1988 Kervagoret ..... 251/129.07
5,056,990 10/1991 Nakajima ..... 417/295

FOREIGN PATENT DOCUMENTS 3936356 5/1990 Fed. Rep. of Germany ..... 417/295
81277 5/1983 Japan ..... 251/129.07
2-64779 5/1990 Japan .
4-8790 1/1992 Japan .

*Primary Examiner*—Leonard E. Smith
*Attorney, Agent, or Firm*—Frishauf, Holtz, Goodman & Woodward

[57] ABSTRACT

A variable capacity compressor comprises a control element for determining the timing of start of compression of refrigerant gas. Control pressure which acts on the control element to displace same between the minimum capacity position and the maximum capacity position is created in a high-pressure chamber by introducing discharge pressure thereinto. An electromagnetic valve opens and closes a passageway which commincates between the high-pressure chamber and a suction chamber by a pulse signal supplied from an ECU to control an amount of refrigerant gas leaking from the former into the latter to thereby control the level of the control pressure. The ECU makes the width of at least a first pulse or at least a first pulse base of the pulse signal wider than that of the following pulses or pulse bases, when the control element should start to be displaced between the minimum capacity position and the maximum capacity position. The control pressure is introduced to act on both ends of a valve body of the electromagnetic valve, whereby it is made possible to open the valve by a small driving force of an electromagnetic actuator thereof.

2 Claims, 11 Drawing Sheets

VARIABLE CAPACITY COMPRESSOR HAVING A CAPACITY CONTROL SYSTEM USING AN ELECTROMAGNETIC VALVE

BACKGROUND OF THE INVENTION

This invention relates to variable capacity compressors for compressing refrigerant gas circulating in an air conditioner adapted especially for use in automotive vehicles, and more particularly to improvements in or to a capacity control system of a compressor of this kind, employing an electromagnetic valve which is opened and closed to control the delivery quantity or capacity of the compressor.

Conventionally, a capacity control system of a variable capacity vane compressor of this kind has been proposed, e.g. by Japanese Provisional Utility Model Publication (Kokai) No. 2-64779 (corresponding to U.S. Pat. No. 5,056,990 to Nakajima), which comprises a control element disposed to rotate between the minimum capacity position and the maximum capacity position for controlling the timing of start of compression, a low-pressure chamber which is defined on one side of a pressure-receiving protuberance of the control element and into which is introduced suction pressure Ps as low pressure, a high-pressure chamber defind on the other side of the pressure-receiving protuberance and into which is introduced discharge pressure Pd as high pressure via a restriction passage to create control pressure Pc therein, the control element being rotated in response to the difference between the sum of the suction pressure Ps introduced into the low-pressure chamber and the urging force of urging means, and the control pressure Pc, and an electromagnetic valve for opening and closing a passageway which communicates between the high-pressure chamber and a suction chamber, wherein the opening and closing of the passageway by the electromagnetic valve is controlled by a pulse signal to control the flow rate of refrigerant gas leaking from the high-pressure chamber into the suction chamber through the passageway to vary the control pressure within the high-pressure chamber such that the control element is rotated in accordance with variation in the control pressure, to thereby control the capacity of the compressor in a continuous manner.

According to this conventional capacity control system, the passageway is opened when a pulse signal supplied to the solenoid of the electromagnetic valve is on, while it is closed when the pulse signal is off. The duty ratio of the pulse signal is controlled in accordance with thermal load on the compressor, whereby the leak amount per unit time of the refrigerant gas is controlled to thereby control the angular position of the control element.

In this prior art, when the angular position of the control element is changed, the duty ratio is maintained at a constant value during a time period between the start of rotation of the control element from a stationary state and stoppage of rotation of same in a desired position. However, this system has the drawback that it is incapable of quickly starting rotation of the control element from a stationary state. More specifically, no countermeasure has been taken against the frictional force (static frictional force) between a seal member mounted on the periphery of the control member and opposed walls of the compressor, and the hysteresis characteristic of the seal member, so that the capacity control system suffers from poor responsiveness and cannot effect smooth and delicate control of the delivery quantity or capacity of the compressor.

In the meanwhile, an electromagnetic valve for use in a capacity control system of this kind has been proposed e.g. by Japanese Utility Model Application No. 2-49277 (corresponding to Japanese Published Utility Model Application (Kokai) No. 4-8790), which comprises a spool valve having a spool valve body which is displaceable between an open position, in which a high-pressure chamber is communicated with a suction chamber, and a closed position, in which the communication between the chambers is cut off, a spring urging the spool valve body toward the closed position, and an electromagnetic actuator which generates an electromagnetic force in response to an external control signal for magnetically attracting the spool valve body toward the open position against the force of the spring.

However, according to this proposed electromagnetic valve, the spool valve body allows control pressure to leak into the suction chamber. This structure requires high airtightness between the spool valve body and its associated parts for prevention of undesired leakage of control pressure through clearances between the spool valve body and its associated parts, which necessitates the use of a spool valve in which the spool valve body has a long stroke. This results in an increased size of the electromagnetic actuator, and hence in an increased size of the compressor. Further, this capacity control system has the drawbacks of increased electric power consumption and poor responsiveness.

SUMMARY OF THE INVENTION

It is a first object of the invention to provide a variable capacity compressor having a capacity control system which is capable of quickly changing the angular position of the control element as well as effecting delicate control of the delivery quantity or capacity of the compressor.

It is a second object of the invention to provide a variable capacity compressor having a capacity control system which enables to design the compressor to be compact in size.

To attain the first object, according to a first aspect of the invention, there is provided a variable capacity compressor including a suction chamber, a discharging space within which discharge pressure prevails, a control element for determining timing of start of compression of a refrigerant gas, the control element having a pressure-receiving portion, a low-pressure chamber within which prevails suction pressure acting on the pressure-receiving portion of the control element, urging means cooperating with the suction pressure for urging the control element toward a minimum capacity position thereof, a high-pressure chamber within which prevails control pressure acting on the pressure-receiving portion of the control element for urging the control element toward a maximum capacity position thereof, high pressure-introducing passage means for introducing the refrigerant gas from the discharging space into the high-pressure chamber to create the control pressure therein, the high pressure-introducing passage means having a restriction hole for restricting flow of the refrigerant gas, a passage for communicating the high-pressure chamber with the suction chamber, an electromagnetic valve for opening and closing the passage, and control means for controlling the opening and closing of the electromagnetic valve by a pulse signal to control an amount of refrigerant gas leaking from the high-pressure chamber into the suction chamber whereby the control pressure within the high-pressure chamber is changed to displace the control element between the minimum capacity position and the maximum capacity position such that the capacity of the compressor is continuously controlled.

The variable capacity compressor according to the first aspect of the invention is characterized in that the control means makes the width of at least a first pulse or at least a first pulse base of the pulse signal wider than that of the following pulses or pulse bases, when the control element is to start to be displaced between the minimum capacity position and the maximum capacity position.

Preferably, the electromagnetic valve is a normally-closed type and the control means makes the width of the at least first pulse of the pulse signal supplied to the electromagnetic valve wider than that of the following pulses, when the control element is to start to be displaced toward the minimum capacity position.

Also preferably, the control means makes the width of the at least first pulse base of the pulse signal supplied to the electromagnetic valve wider than the following pulse bases, when the control element is to start to be displaced toward the maximum capacity position.

More preferably, the frequency of the pulse signal is variable and the pulse width of the pulse signal is normally constant.

Preferably, the pulse width of the at least a first pulse of the pulse signal is corrected by a first correction value determined depending on ambient temperature.

Also preferably, the width of the at least a first pulse base of the pulse signal is corrected by a second correction value determined depending on ambient temperature.

To attain the second object, according to a second aspect of the invention, there is provided a variable capacity compressor including a suction chamber, a discharging space within which discharge pressure prevails, a control element for determining timing of start of compression of a refrigerant gas, the control element having a pressure-receiving portion, a low-pressure chamber within which prevails suction pressure acting on the pressure-receiving portion of the control element, urging means cooperating with the suction pressure for urging the control element toward a minimum capacity position thereof, a high-pressure chamber within which prevails control pressure acting on the pressure-receiving portion of the control element for urging the control element toward a maximum capacity position thereof, high pressure-introducing passage means for introducing the refrigerant gas from the discharging space into the high-pressure chamber to create the control pressure therein, the high pressure-introducting passage means having a restriction hole for restricting flow of the refrigerant gas, a passage for communicating the high-pressure chamber with the suction chamber, a valve body for opening and closing the passage, a plunger, a coiled spring urging the valve body in a valve-closing direction through the plunger, and an electromagnetic actuator for magnetically attracting the plunger in a valve-opening direction against the urging force of the coiled spring.

The variable capacity compressor according to the second aspect of the invention is characterized by comprising passageway means applying the control pressure to one end of the valve body in the valve-opening direction, and at the same time applying the control pressure to another end of the valve body in the valve-closing direction.

Preferably, the plunger has a transverse through hole formed therein for introducing the control pressure thereinto such that the control pressure acts to urge the valve body in the valve-closing direction through the plunger.

More preferably, the valve body is formed of a ball valve.

The above and other objects, features, and advantages of the invention will become more apparent from the ensuing detailed description taken in conjunction with the accompanying drawings.

DETAILED DESCRIPTION

The invention will now be described in detail with reference to the drawings showing embodiments thereof.

Figure 1:
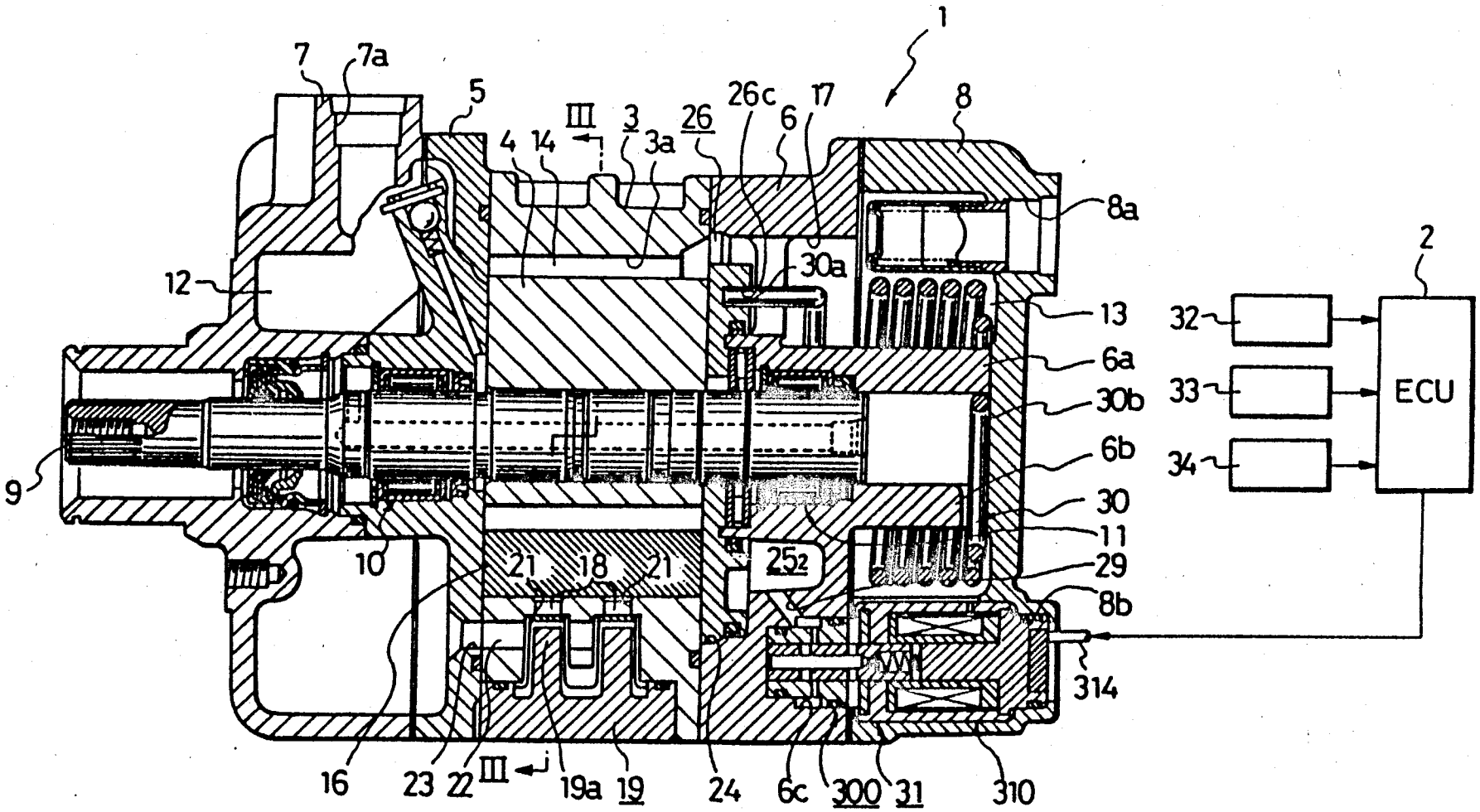
FIG. 1 is a longitudinal cross-sectional view of a variable capacity compressor including a capacity control system according to a first embodiment of the invention.

FIG. 1 shows a variable capacity compressor 1 including a capacity control system according to a first embodiment of the invention. This compressor is used e.g. for an air conditioner installed on an automotive vehicle, and includes a control valve device 31, and an electronic control unit (hereinafter simply referred to as "ECU") 2, as parts of the capacity control system.

The variable capacity vane compressor 1 is mainly composed of a cylinder formed by a cam ring 3 having a comming inner peripheral surface 3a with a generally elliptical cross section, and a front side block 5 and a rear side block 6 closing open opposite ends of the cam ring 3, a cylindrical rotor 4 rotatably received within the cylinder, a front head 7 and a rear head 8 secured to outer ends of the respective front and rear side blocks 5 and 6, and a driving shaft 9 on which is secured the rotor 4. The driving shaft 9 is rotatably supported by a pair of radial bearings 10 and 11 provided in the respective side blocks 5 and 6.

A discharge port 7a is formed in an upper wall of the front head 7, through which a refrigerant gas is to be discharged as a thermal medium, while a suction port 8a is formed in an upper rear end wall of the rear head 8, through which the refrigerant gas is to be drawn into the compressor. The discharge port 7a and the suction port 8a communicate, respectively, with a discharge pressure chamber 12 defined by the front head 7 and the front side block 5, and a suction chamber 13 defined by the rear head 8 and the rear side block 6.

Figure 3:
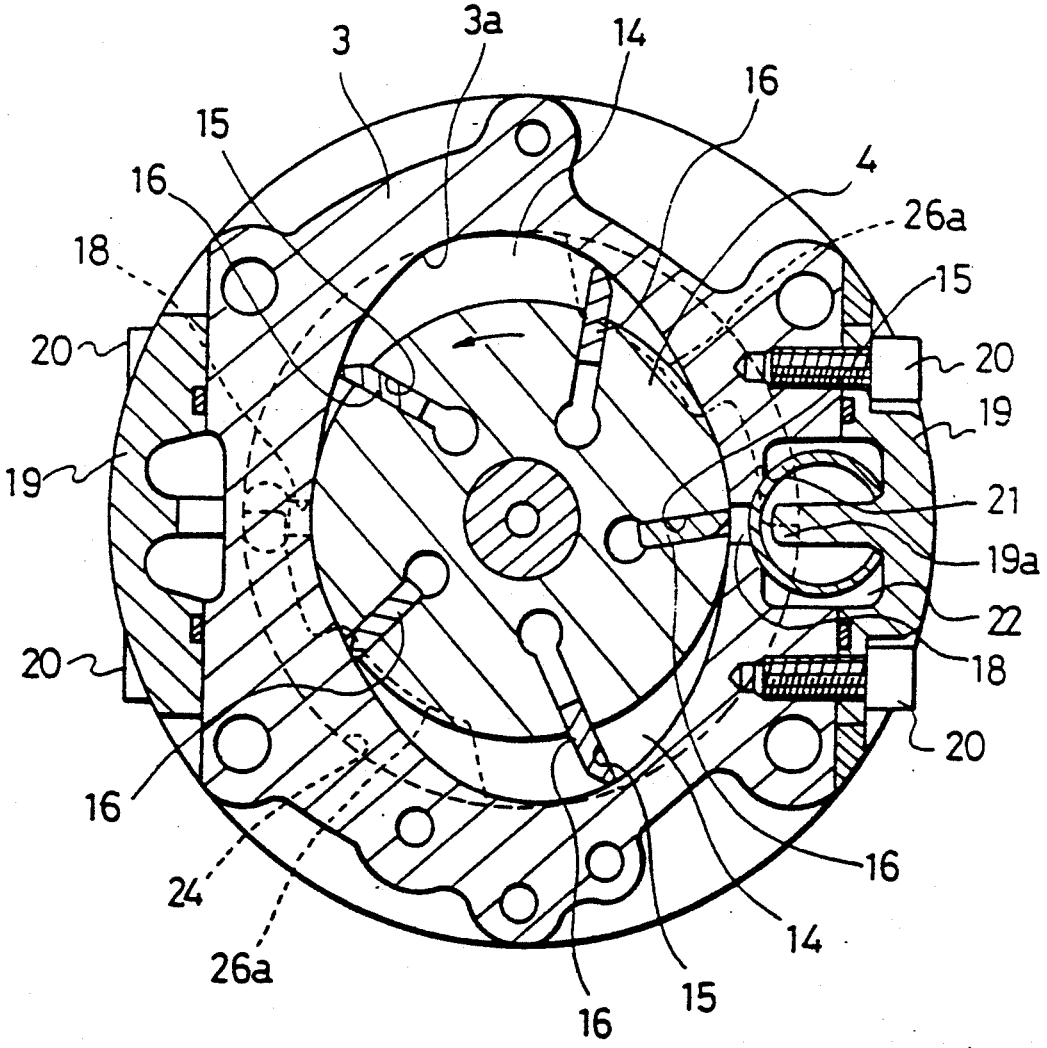
FIG. 3 is a transverse cross-sectional view taken along line III—III in FIG. 1, showing a control element in its maximum capacity position.

As shown in FIG. 3, a pair of compression spaces 14, 14 are defined at diametrically opposite locations between the inner peripheral surface 3a of the cam ring 3, the outer peripheral surface of the rotor 4, an end face of the front side block 5 on the cam ring 3 side, and an end face of a control element 26, referred to hereinafter, on the cam ring 3 side. The rotor 4 has its outer peripheral surface formed therein with a plurality of axial vane slits 15 at circumferentially equal intervals, in each of which a vane 16 is radially slidably fitted.

Refrigerant inlet ports 17, 17 are formed in the rear side block 6 at diametrically opposite locations, as shown in FIG. 1 (since FIG. 1 shows a cross-section taken at an angle of 90° formed about the longitudinal axis of the compressor, only one refrigerant inlet port is shown in the figure.) These refrigerant inlet ports 17 axially extend through the rear side block 6, and through which the suction chamber 13 and the compression spaces 14 are communicated with each other.

Two pairs of refrigerant outlet ports 18, 18 are formed through opposite lateral side walls of the cam ring 3 at diametrically opposite locations as shown in FIGS. 1 and 3 (in FIG. 1, for the same reason as in the case of the refrigerant inlet ports, only one pair of the refrigerant outlet ports is shown). A discharge valve cover 19 having valve stoppers 19a is secured by bolts 20 to each of the opposite lateral side walls of the cam ring having the refrigerant outlet ports 18, 18 formed therein. Disposed between the lateral side wall and each of the valve stopper 19a is a discharge valve 21 which is retained on the discharge valve cover 19. The discharge valve 21 opens the associated refrigerant outlet port 18 in response to discharge pressure. A pair of discharging spaces 22, 22 which communicate with the respective pairs of refrigerant outlet ports 18 when the discharge valves 21 open are defined between the cam ring 3 and the respective discharge valve covers 19 at diametrically opposite locations. A pair of passages 23 are formed in the front side block 5 at diametrically opposite locations thereof, which each communicate with a corresponding one of the discharging spaces 22, whereby when each discharge valve 21 opens to thereby open the corresponding refrigerant outlet port 18, a compressed refrigerant gas in the compression space 14 is discharged from the discharge port 7a via the refrigerant outlet port 18, the discharging space 22, the passage 23, and the discharge pressure chamber 12, in the mentioned order.

Figure 2:
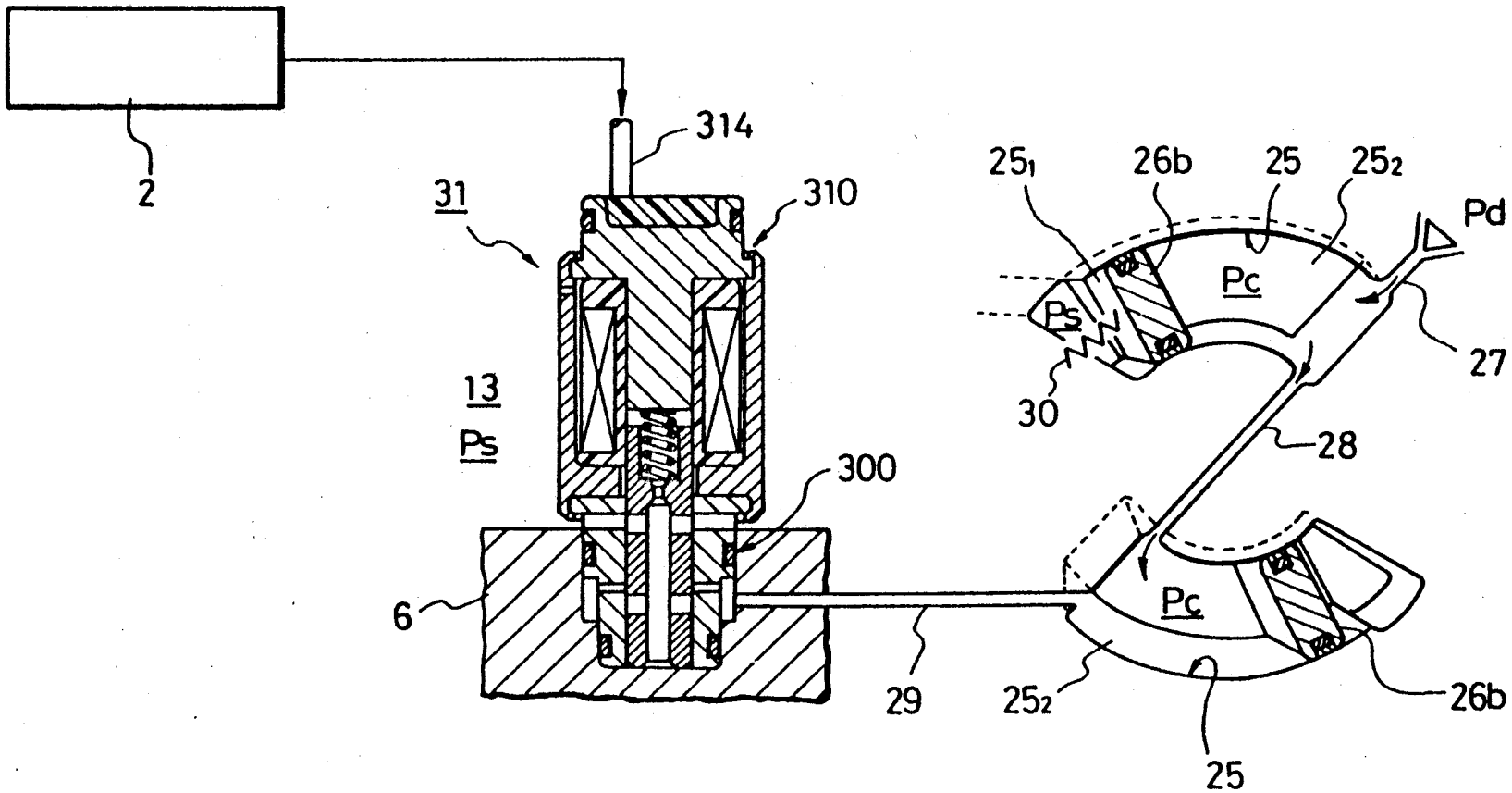
FIG. 2 is a view showing essential parts of the capacity control system appearing in FIG. 1.

As shown in FIG. 1, the rear side block 6 has an end face facing the rotor 4, in which is formed an annular recess 24. A pair of pressure working chambers 25, 25 are formed in a bottom of the annular recess 24 at diametrically opposite locations. The aforementioned control element 26, which is in the form of an annulus, is received in the annular recess 24 for rotation about its own axis in opposite circumferential directions. The control element 26 controls the timing of start of compression of the compressor, and has its outer peripheral edge formed with a pair of diametrically opposite arcuate cut-out portions 26a, 26a (see FIG. 3), and its one side surface formed integrally with a pair of diametrically opposite pressure-receiving protuberances 26b, 26b axially projected therefrom and acting as pressure-receiving elements (see FIG. 2). The pressure-receiving protuberances 26b, 26b are slidably received in respective pressure working chambers 25, 25. The interior of each pressure working chamber 25 is divided into a low-pressure chamber $25_1$ and a high-pressure chamber $25_2$ by the associated pressure-receiving protuberance 26b. Each low-pressure chamber $25_1$ communicates with the suction chamber 13 through the corresponding refrigerant inlet port 17 to be supplied with refrigerant gas under suction pressure Ps or low pressure. On the other hand, one of the high-pressure chambers $25_2$, $25_2$ is connected to one of the discharging spaces 22 by way of a restriction passage 27. The high-pressure chambers $25_2$, $25_2$ are connected to each other through a passage 28. In each of the high-pressure chambers $25_2$, $25_2$, control pressure Pc prevails, which is created by introducing into the chamber $25_2$ refrigerant gas under discharge pressure Pd or high pressure from the discharging space 22 by way of the restriction passage 27. As shown in FIGS. 1 and 2, one of the high-pressure chambers $25_2$, $25_2$ can be connected to the suction chamber 13 via a passage 29 formed in the rear side block 6 and a control valve device 31 as a part of the capacity control system.

Figure 4:
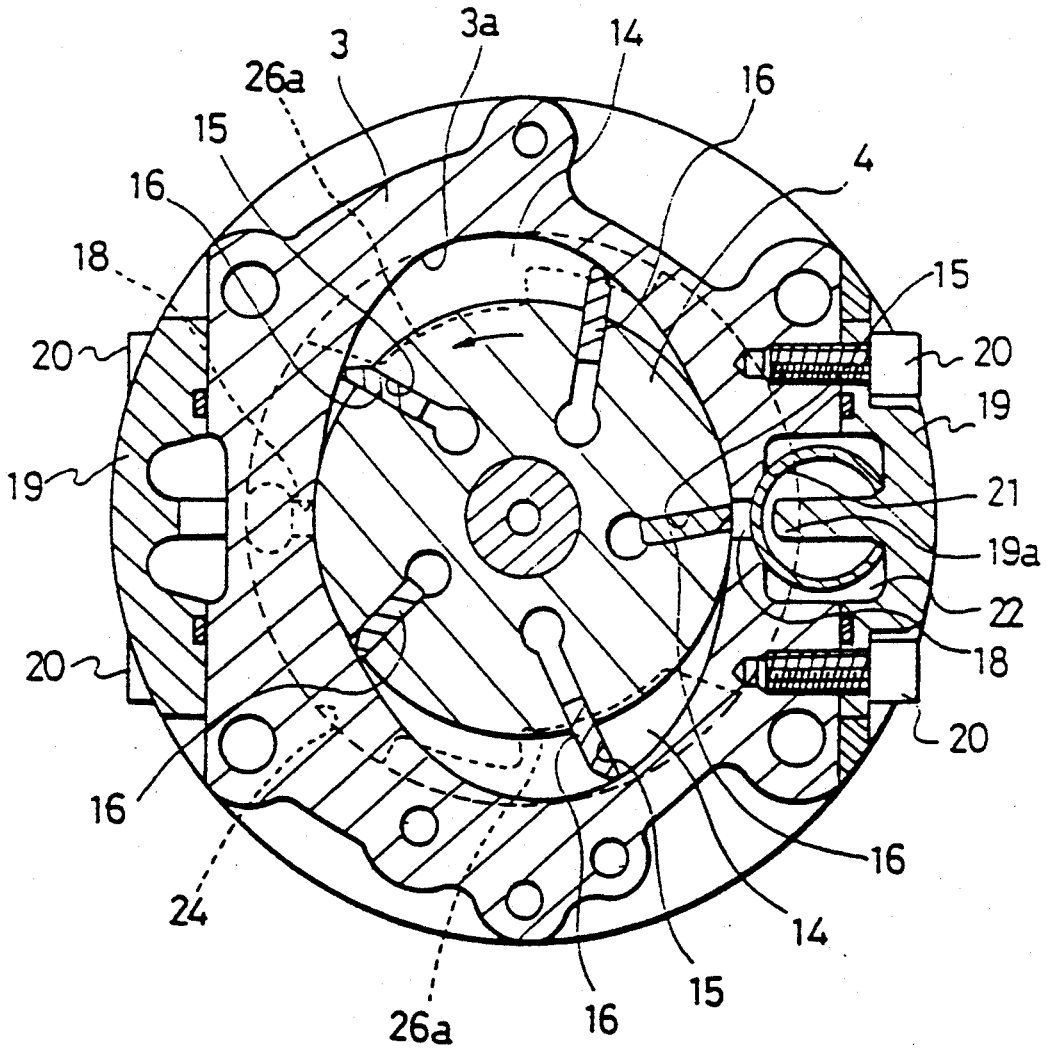
FIG. 4 is a view similar to FIG. 3, showing the control element in its minimum capacity position.

The control element 26 is urged by a torsion coiled spring 30 toward the minimum capacity position shown in FIG. 4, in which the timing of start of compression of the compressor is the latest, and is rotatable between the maximum capacity position shown in FIG. 3, in which the timing of start of compression of the compressor is the earliest, and the minimum capacity position shown in FIG. 4, in accordance with the difference between the sum of the suction pressure Ps and the urging force of the torsion coiled spring 30, and the control pressure Pc.

As shown in FIG. 1, the torsion coiled spring 30 has one end 30a thereof engaged in a hole 26c formed in the control element 26 and the other end 30b thereof retained in a groove 6b formed in an end face of a hub 6a of the rear side block 6 axially extending toward the rear head 8 side.

Figure 5:
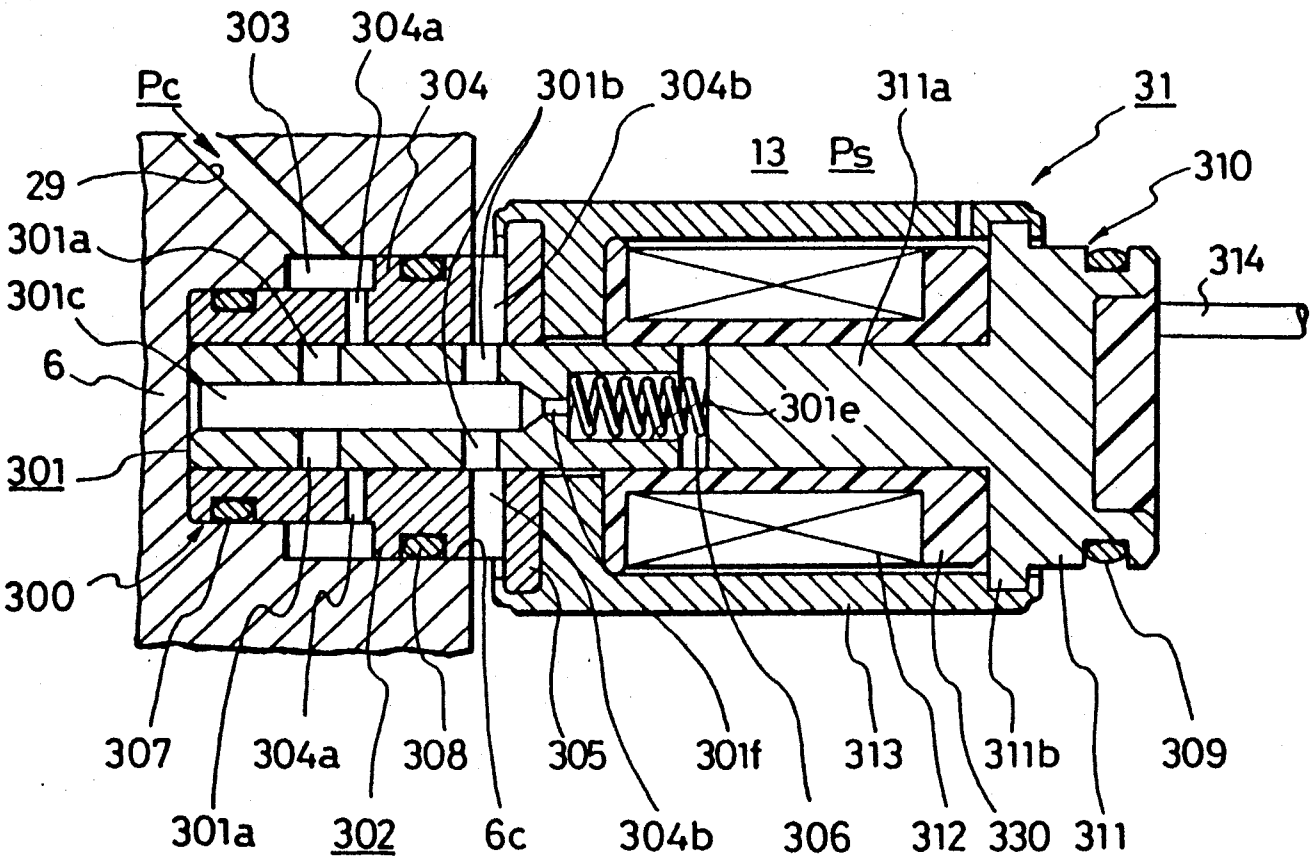
FIG. 5 is an enlarged longitudinal cross-sectional view of an electromagnetic valve appearing in FIGS. 1 and 2.

As shown in FIGS. 1 and 5, the control valve device 31 is formed of an electromagnetic spool valve which comprises a spool valve 300 having a spool valve body 301 which is biased toward a closed position by a coiled spring 306 and displaceable between an open position in which the high-pressure chamber $25_2$ is allowed to communicate with the suction chamber 13 and the closed position in which the communication between the chambers is cut off, and an electromagnetic actuator 310 which generates an electromagnetic force in response to a pulse signal from the ECU 2 for urging the spool valve body 301 toward the open position.

The spool valve 300 comprises a hollow cylinder 302 fitted in a recess 6c formed in the rear side block 6, and the spool valve body 301 which is slidable to change its position in the hollow cylinder 302. The hollow cylinder 302 has a cylindrical portion 304 which has an enlarged portion and is fitted in the recess 6c formed in the rear side block to define an annular space 303 between walls of the recess 6c and the outer peripheral surfaces of the cylindrical portion 304, and a flange portion 305. The cylinder portion 304 has a pair of inlet ports 304a, 304a radially formed through a peripheral wall thereof at diametrically opposite locations, each of which communicates with the annular space 303, and a pair of outlet ports 304b, 304b radially formed through the peripheral wall thereof at diametrically opposite locations, each of which communicates with the suction chamber 13. The spool valve body 301 has a central internal passage 301c axially formed therein, a pair of inlet ports 301a, 301a formed through a peripheral wall thereof for communication with respective corresponding ones of the inlet ports 304a, 304a, each of which communicates with the central internal passage 301c, a pair of outlet ports 301b, 301b formed through the peripheral wall thereof for communication with respective corresponding ones of the outlet ports 304b, 304b, each of which communicates with the central internal passage 301c, a recess 301e formed in one end of the spool valve body 301 for receiving the aforementioned coiled spring 306, and a communication hole 301f which communicates between the recess 301e and the central internal passage 301c. Sealing members 307, 308 are interposed between the outer peripheral surfaces of the cylinder 304 and the wall surfaces of the recess 6c to effect airtight sealing therebetween. The spool valve 300 operates such that when the spool valve body 301 is in the closed position as shown in FIG. 5, the inlet ports 304a are closed by the outer peripheral surface of the spool valve body 301 and at the same time the corresponding outlet ports 301b and 304b communicate with each other, whereas when the spool valve body 301 is slightly displaced rightward as viewed in FIG. 5 into the open position, the corresponding inlet ports 301a and 304a communicate with each other while maintaining communication between the corresponding outlet ports 301b and 304b.

The electromagnetic actuator 310 comprises a core 311 formed of a magnetic material and fitted in a mounting hole 8b formed in the rear head 8, a solenoid 312 fitted around a bobbin 330 enclosing an axial portion 311a of the core 311, and a cover 313 formed of a magnetic material and arranged to enclose the solenoid 312 and having both ends thereof caulked on the flange portion 305 of the hollow cylinder 302 and a flange portion 311b of the core 311. Connected to the electromagnetic actuator 310 is a wire 314 for supplying the pulse signal to the solenoid 312 from the ECU 2. One end of the coiled spring 306 abuts on an end face of the axial portion 311a of the core 311 to bias the spool valve body 301 toward the closed position as shown in FIG. 2. A sealing member 309 is interposed between the outer peripheral surface of the core 311 and the wall surface of the mounting hole 8b of the rear head 8 to effect airtight sealing therebetween.

The electromagnetic actuator 310 is energized by pulses of the pulse signal from the ECU 2 to generate an electromagnetic force to displace the spool valve body 301 from the closed position to the open position (rightward as viewed in FIG. 5) against the biasing force of the spring 306.

Electrically connected to the ECU 2 are an ambient temperature sensor 32 for detecting ambient temperature T, an evaporator temperature sensor 33 for detecting the temperature $T_E$ of refrigerant gas at an outlet port of an evaporator of the air conditioner, not shown, and an engine rotational speed sensor 34 for detecting the rotational speed Ne of an engine, not shown, installed on the automotive vehicle and drivingly connected to the compressor. These sensors 32, 33, and 34 supply signals indicative of respective detected parameters to the ECU 2. The ECU 2 determines a pulse signal to be supplied to the electromagnetic actuator 310 based on the signals supplied from these sensors, to thereby control opening/closing operation of the spool valve body 301.

Next, there will be described the operation of the capacity control system of the variable capacity compressor having the above described construction.

Figure 6:
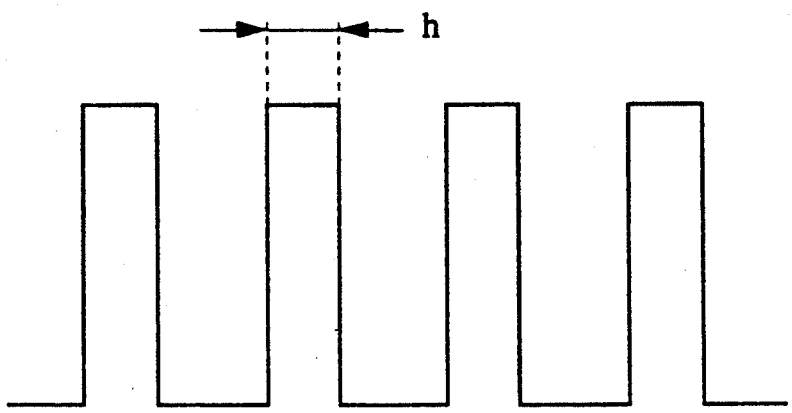
FIG. 6 is a view showing a waveform of a pulse signal supplied to the electromagnetic valve.

The ECU 2 supplies a pulse signal, e.g. one shown in FIG. 6, to the solenoid 312 of the electromagnetic actuator 310. The pulse signal has a pulse width h which is normally constant, while its frequency F is determined by the following equation (1):

$$F=f+\alpha+\beta+\gamma \quad (1)$$

where f represents a basic frequency, and $\alpha$, $\beta$, and $\gamma$ represent correction values determined depending on the ambient temperature T, the temperature $T_E$ of refrigerant gas at the outlet port of the evaporator, and the engine rotational speed Ne, respectively. The correction values $\alpha$, $\beta$, and $\gamma$ can be obtained by tables shown in FIGS. 7, 8 and 9, respectively. By adding the correction values $\alpha$, $\beta$, and $\gamma$ to the basic frequency f, the frequency of the pulse signal is responsive to thermal load on the air conditioner. When the thus obtained pulse signal is supplied to the electromagnetic actuator 310 to energize the solenoid 312, the electromagnetic actuator 310 generates an electromagnetic force to displace the spool valve body 301 from the closed position shown in FIG. 5, rightward as viewed in same, into the open position. In the open position, while communication between the outlet ports 301b of the spool valve body 301 and the corresponding outlet ports 304b of the hollow cylinder is maintained, the inlet ports 301a of the spool valve body 301 communicate with the corresponding inlet ports 304a of the hollow cylinder 302, whereby control pressure Pc prevailing in the high-pressure chamber $25_2$ is allowed to leak into the suction chamber 13 via the passage 29, the annular space 303, the inlet ports 304a, the inlet ports 301a, the central internal passage 301c, the outlet ports 301b, and the outlet ports 304b.

In contrast, when the solenoid 312 of the electromagnetic actuator is not energized, the electromagnetic actuator does not generate an electromagnetic force, so that the spool valve body 301 is in the closed position as shown in FIGS. 2 and 5. In the closed position, the inlet ports 304a of the hollow cylinder 302 are closed by the outer peripheral surface of the spool valve body 301, so that the communication between the high-pressure chamber $25_2$ and the suction chamber 13 is cut off, whereby the control pressure Pc within the high-pressure chamber $25_2$ is increased.

Figure 7:
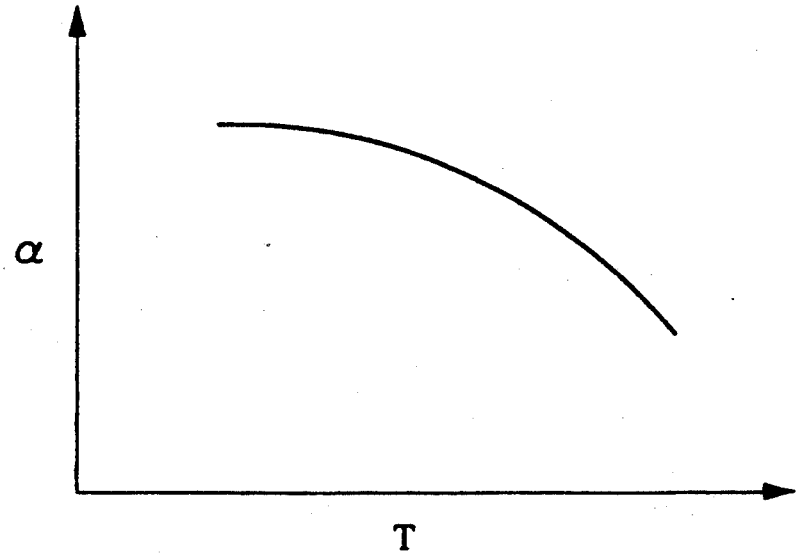
FIG. 7 is a view showing a diagram showing an ambient temperature-dependent correction value for correcting the frequency of the pulse signal.
Figure 8:
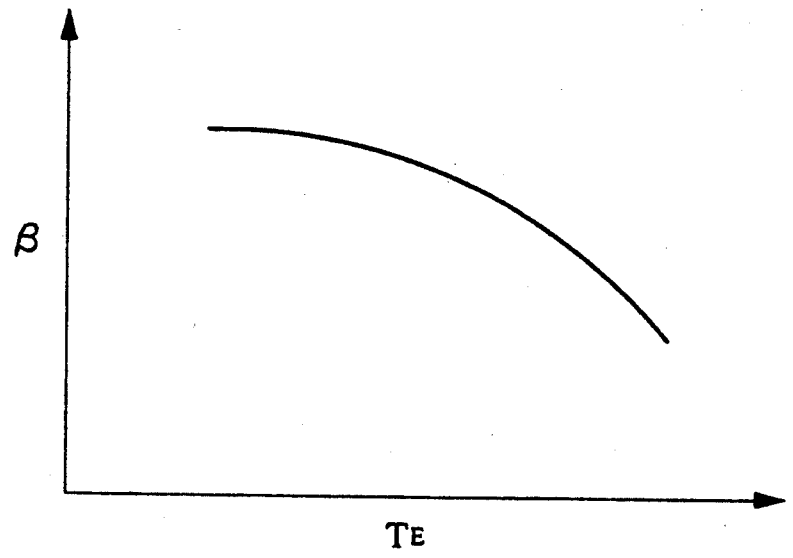
FIG. 8 is a view showing a diagram showing a correction value for correcting the frequency of the pulse signal, the correction valve being dependent on the temperature of refrigerant gas at an outlet port of an evaporator.
Figure 9:
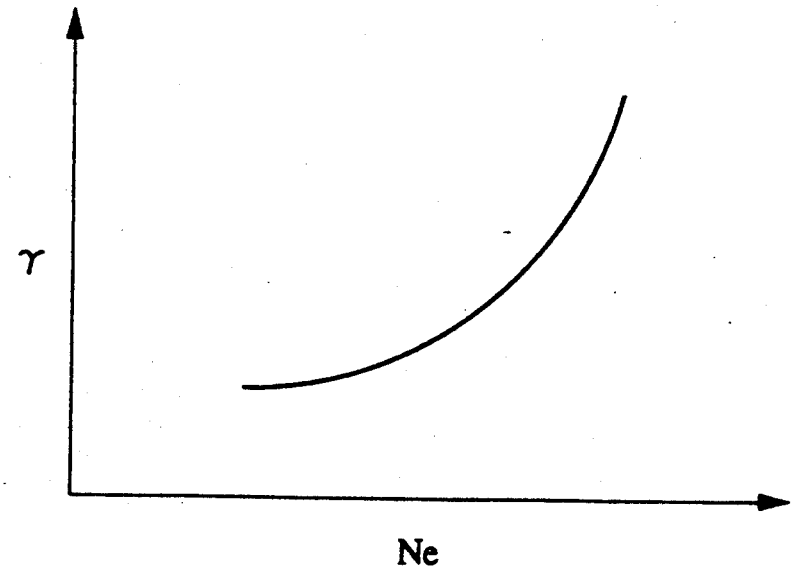
FIG. 9 is a view showing an engine rotational speed-dependent correction value for correcting the frequency of the pulse signal.

Thus, the control pressure Pc is increased while the solenoid 312 is not energized, and is decreased while the latter is energized. Further, the higher the frequency F of the pulse signal, the lower the control pressure Pc. For example, when the ambient temperature T is high and hence the thermal load on the compressor is heavy, which in turn results in a high temperature $T_E$ of refrigerant gas at the outlet port of the evaporator, the correction values $\alpha$ and $\beta$ assume small values as shown in FIGS. 7 and 8, so that the calculated frequency F is low. Therefore, the spool valve body 301 is held toward the closed position to increase the control pressure Pc, which in turn causes the control element 26 to rotate toward the maximum capacity position shown in FIG. 3 to advance the timing of start of compression of the compressor to thereby increase the delivery quantity or capacity of the compressor. Inversely, when the ambient temperature T is low and hence the thermal load on the compressor is light, which in turn results in a low temperature $T_E$ of refrigerant gas at the outlet port of the evaporator, the correction values $\alpha$ and $\beta$ assume large values, so that the calculated frequency F is high. Therefore, the spool valve body 301 is held toward the open position to decrease the control pressure Pc, which in turn causes the control element 26 to rotate toward the minimum capacity position shown in FIG. 4 to retard the timing of start of compression of the compressor to thereby decrease the delivery quantity or capacity of the compressor.

Further, the higher the engine rotational speed Ne, the larger the correction value $\gamma$ (see FIG. 9), so that when the engine rotational speed Ne is higher, the calculated frequency F becomes higher, whereby the control pressure Pc is decreased to rotate the control element 26 toward the minimum capacity position shown in FIG. 4 to thereby decrease the capacity of the compressor, thus preventing excessive cooling when the engine rotational speed Ne is high.

Figure 10:
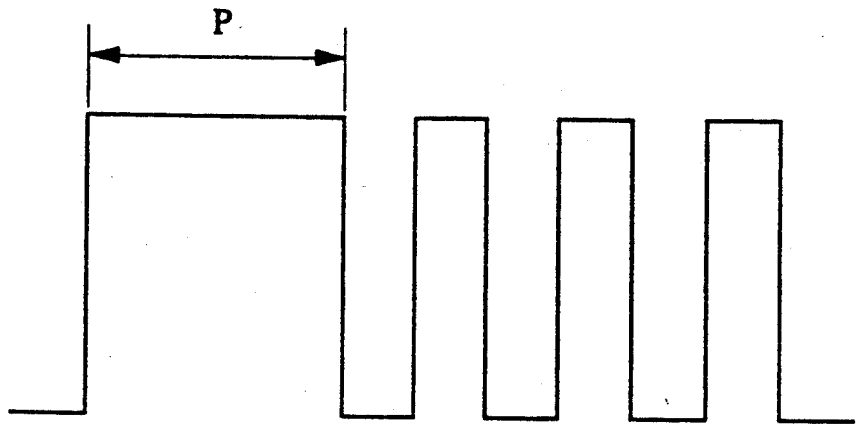
FIG. 10 is a view showing a waveform of the pulse signal which is used for rotating the control element toward the minimum capacity position.
Figure 11:
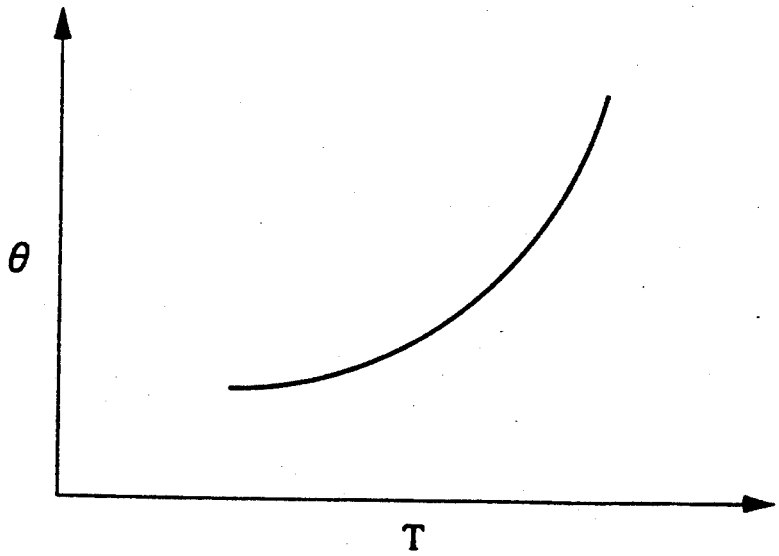
FIG. 11 is a view showing a diagram showing an ambient temperature-dependent correction value for correcting the pulse width P of the pulse signal.

When the frequency F of the pulse signal is changed due to change in the thermal load, and accordingly the angular position of the control element 26 is to be changed, the ECU 2 carries out the capacity control in the following manner:

When the thermal load decreases and accordingly the angular position of the control element 26 is to be changed from the maximum capacity position side to the minimum capacity position side, the ECU 2 makes wider the width of the first pulse of the pulse signal supplied to the solenoid 312 of the electromagnetic actuator 310 than that of the following pulses (see FIG. 10). The pulse width P of the first pulse is calculated based on the following equation (2):

$$P=t+\theta \quad (2)$$

where t represents a basic pulse width, and $\theta$ a correction value determined depending on the ambient temperature T. The correction value $\theta$ can be obtained by a table shown in FIG. 11. As can be seen from the figure, the correction value $\theta$ assumes a larger value as the ambient temperature is higher, so that the calculated pulse width P becomes wider. When the first pulse of the pulse signal having the thus obtained pulse width is supplied to the electromagnetic actuator 310, the solenoid 312 is energized by the first pulse for a longer time period to decrease the control pressure Pc, which causes the control element 26 to more readily rotate toward the minimum capacity position. Thus, when the angular position of the control element 26 is to be changed from the maximum capacity position side to the minimum capacity position side, the pulse width P of the first pulse of the pulse signal is wider than that of the following pulses, whereby it is possible to prevent the capacity control from being affected by the frictional force between the seal member, not shown, mounted on the periphery of the control member 26 and opposed walls of the compressor, and the hysteresis characteristic of the seal member, which in turn enables to quickly rotate the control element 26.

Further, the pulse width P is determined depending on the correction value $\theta$, that is, the higher the ambient temperature T, the wider the pulse width P. Therefore, even when the ambient temperature T is higher and hence the control pressure Pc is higher, the first pulse having the pulse width P corresponding to the ambient temperature T is supplied to the solenoid 312, whereby the control pressure Pc can be drastically decreased to thereby quickly rotate the control element 26 toward the minimum capacity position.

Figure 12:
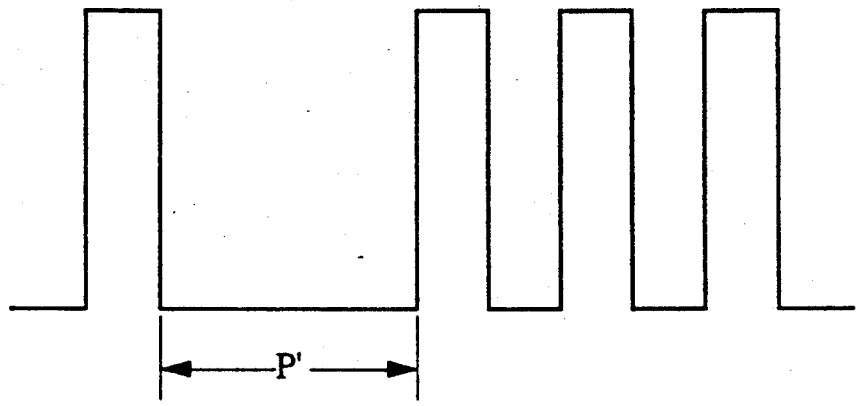
FIG. 12 is a view showing a waveform of the pulse signal which is used for rotating the control element toward the maximum capacity position.
Figure 13:
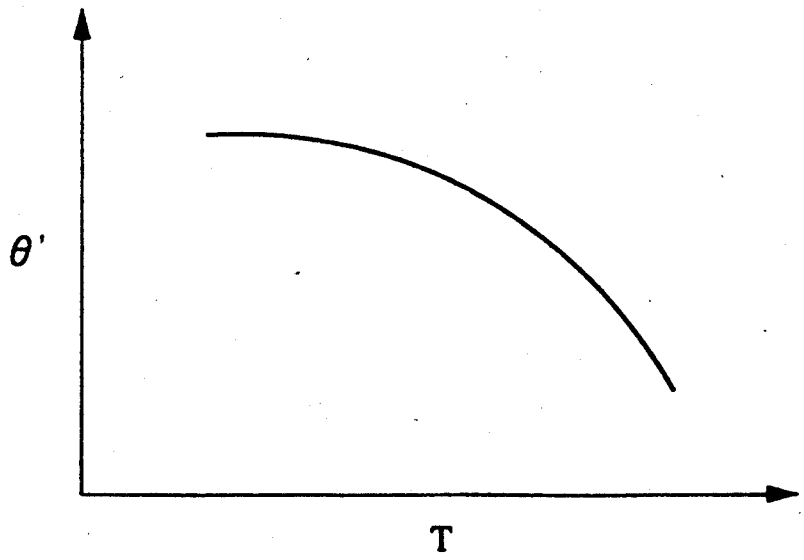
FIG. 13 is a view showing a diagram showing an ambient temperature-dependent correction value for correcting the off time period P' of the pulse signal.

Next, when the thermal load increases and accordingly the angular position of the control element 26 is to be changed from the minimum capacity position side to the maximum capacity position side, the ECU 2 once inhibits the supply of the pulse signal to the solenoid 312 of the electromagnetic actuator 310 for a predetermined time period P', and after the lapse of the predetermined time period, the supply of the pulse signal is restored. That is, as shown in FIG. 12, the width P' of a first pulse base of the pulse signal is prolonged to a value corresponding to the predetermined time period. The pulse base width (predetermined time period) P' is calculated based on the following equation (3):

$$P'=t'+\theta' \quad (3)$$

where t' represents a basic time period during which the supply of pulses of the pulse signal is inhibited, and $\theta'$ a correction value determined depending on the ambient temperature T. The correction value $\theta'$ can be obtained by a table shown in FIG. 13. As can be seen from the figure, the correction value $\theta'$ assumes a larger value as the ambient temperature is lower, so that the calculated predetermined time period P' becomes longer. If the supply of the pulse signal to the electromagnetic actuator 310 is inhibited for the thus obtained predetermined time period P', the control pressure Pc is increased to cause the control element 6 to more readily rotate toward the maximum capacity position. Thus, when the angular position of the control element 26 is changed from the minimum capacity position side to the maximum capacity position side, the supply of the pulse signal to the electromagnetic actuator 310 is inhibited for the predetermined time period P', whereby it is possible to prevent the capacity control from being affected by the frictional force between the seal member, not shown, mounted on the periphery of the control member 26 and opposed walls of the compressor, and the hysteresis characteristic of the seal member, which in turn enables to quickly rotate the control element 26.

Further, the predetermined time period P' is determined depending on the correction value $\theta'$, and the lower the ambient temperature T, the longer the predetermined time period P'. Therefore, even when the ambient temperature is lower and hence the control pressure Pc is lower, the supply of the pulse signal to the electromagnetic actuator is inhibited for the predetermined time period P' corresponding to the ambient temperature T, whereby the control pressure Pc can be drastically increased to thereby quickly rotate the control element 26 toward the maximum capacity position.

Although in the above described embodiment, the electromagnetic valve is a normally-closed type in which when the solenoid 312 is energized by pulses of pulse signal, the valve is opened, the valve may be a normally-open type in which when the solenoid 312 is deenergized by pulse bases of the pulse signal, the valve is open.

Further, not only the width of the first pulse on the first pulse base but also the width of the first two or more pulses or the first two or more pulse bases may be utilized.

Next, a second embodiment of the invention will be described in detail with reference to FIG. 14. This embodiment is different from the first embodiment only in the construction of the control valve device 31. Therefore, in FIG. 14 elements and parts corresponding to those in the first embodiment are indicated by identical reference numerals, and detailed description thereof is omitted.

Figure 14:
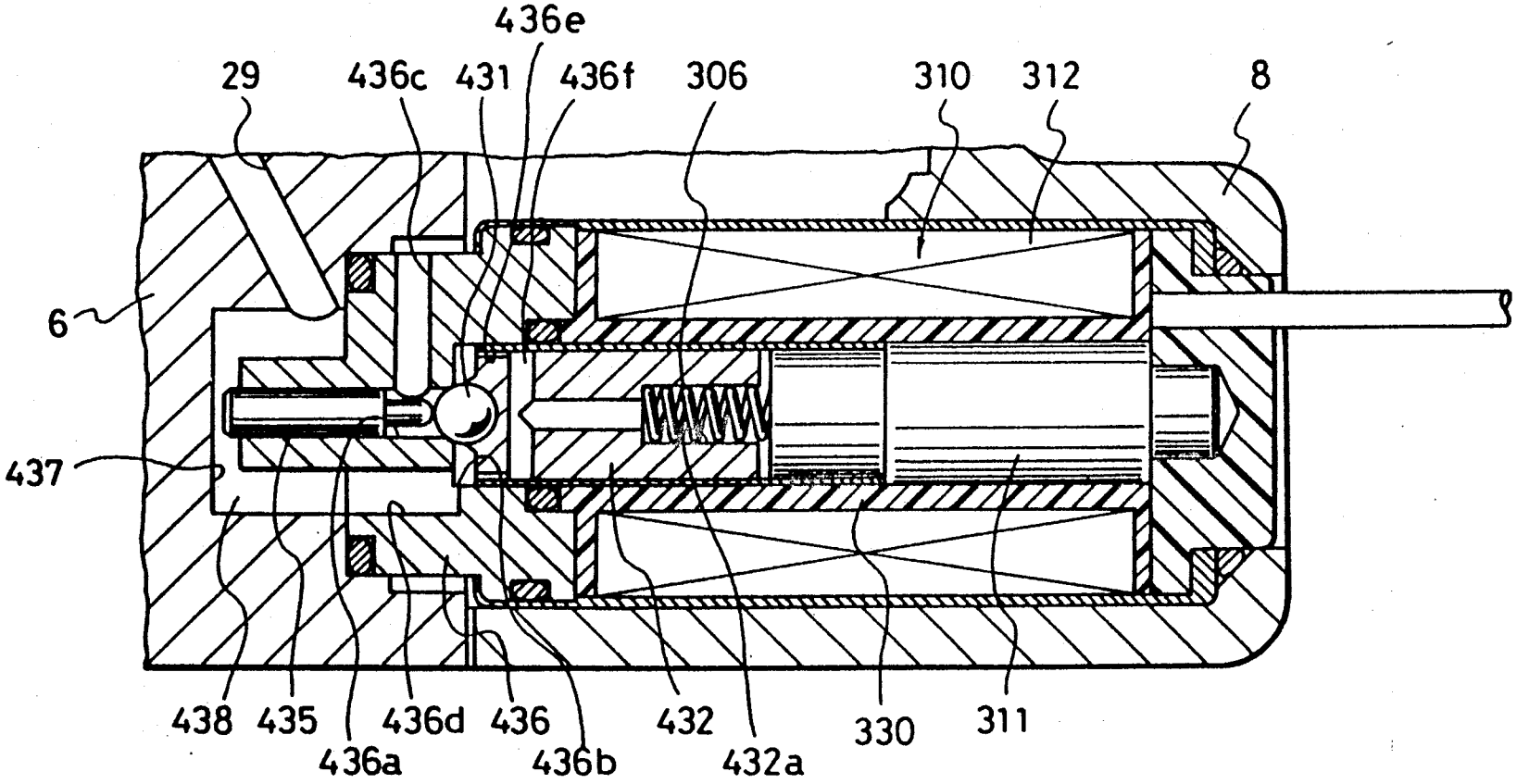
FIG. 14 is a longitudinal cross-sectional view showing essential parts of a capacity control system according to a second embodiment of the invention.

As shown in FIG. 14, the control valve device 31 according to the second embodiment is formed of an electromagnetic valve which comprises a ball valve 431 which opens and closes the passage 29 connecting the high-pressure chamber $25_2$ to the suction chamber 13, a plunger 432 which is axially slidable, the coiled spring 306 urging the ball valve 431 toward the closed position through the plunger 432, the electromagnetic actuator 310 which magnetically attracts the plunger 432 against the urging force of the coiled spring 306 when energized, a rod 435 axially opposed to the plunger 432 through the ball valve 431, and a cylindrical holder 436 holding the rod 435 such that the latter is slidable within the former.

The holder 436 is mounted in a mounting recess 437 formed in the rear side block 6, and the rod 435 is slidably fitted in a reduced-diameter hole **436*a* formed in the holder 436. The rod 435 has a stepped body having a reduced-diameter end portion on the ball valve 431 side. The holder 436 also has an increased-diameter hole 436*b* which is continuous with the reduced-diameter hole 436*a* for communication with the latter when the valve is open. One end of the plunger 432 is inserted into the increased-diameter hole 436*b* with the ball valve 431 received in a recessed end face of the plunger 432. Defined between the holder 436 and inner wall surfaces of the mounting recess 437 is a space 438 forming part of the passage 29. The holder 436 has a passage 436*c* formed therein which communicates between the reduced-diameter hole 436*a* and the suction chamber 13, and a passage 436*d* formed therein which communicates between the space 438 and the increased-diameter hole 436*b*. The plunger 432 has a transverse through hole 436*f* formed therein, and axial slits 436*e* formed in the outer periphery of the plunger 432 and extending between the recessed end face thereof on the ball valve side and the through hole 436*f*, so that the through hole 436*f* is communicated to the space 438 via the slits 436*e*, the increased-diameter hole 436*b*, and the passage 436*d*. The plunger 432 has a spring-receiving hole 432*a* formed therein for receiving the spring 306**.

The electromagnetic actuator 310 comprises the core 311 formed of a magnetic material and having one end thereof secured to the rear head 8, and the solenoid 312 fitted around the bobbin 330 enclosing the core 311. One end of the coiled spring 306 abuts on an opposed end face of the core 311, whereby the plunger 432 is biased toward the reduced-diameter hole **436*a* by the urging force of the coiled spring 306, so that the ball valve 431 is pressed against an opposed open end of the reduced-diameter hole 436*a*** to close the electromagnetic valve.

Next, the operation of the second embodiment of the invention will be described.

When the solenoid 312 of the electromagnetic actuator 310 is not energized (as in FIG. 14), the urging force of the spring 306 causes the ball valve 431 to abut against the marginal edge (valve seat) of the open end of the reduced-diameter hole **436*a* through the plunger 432, whereby the valve is maintained in the closed position. In the closed position, the communication between the reduced-diameter hole 436*a* and the increased-diameter hole 436*b* of the holder 436 is cut off to thereby increase the control pressure Pc in the high-pressure chamber $25_2$. As a result, the control element 26** is urged toward the maximum capacity position.

Provided that the cross-sectional area of the valve seat is represented by $S_1$, the pressure-receiving area of the end face of the rod 435 receiving the control pressure by $S_2$, and the urging force (setting load) of the coiled spring 306 by $F_{SP}$, the following expression is satisfied when the valve is closed:

$$Pc \times S_1 + F_{SP} > Pc \times S_2 + Psmax \times S_1$$

Assuming that $S_1 = S_2$, the terms Pc on both sides cancel each other, so that the above expression is simplified as follows:

$$F_{SP} > Psmax \times S_1$$

Specifically, the control pressure Pc acts on one end face (the left hand end face as viewed in FIG. 14) of the rod 435, and at the same time the control pressure Pc is introduced into the through hole **436*f* via the passage 436*d*, the increased-diameter hole 436*b*, and the slits 436*e* to act on the other end face (the right hand end face as viewed in FIG. 14) of the rod 35 through the ball valve 431, so that the control pressure Pc urging the rod 435 in the valve-opening direction is cancelled, which makes it unnecessary to make large the urging force or setting load of the coiled spring 306**.

On the other hand, when the solenoid 312 of the electromagnetic actuator 310 is energized, the electromagnetic force generated thereby attracts the plunger 432 in a direction away from the rod 435 against the urging force of the coiled spring 306, whereby the ball valve 431 opens the open end of the reduced-diameter hole **436*a*, i.e. the electromagnetic valve is opened. Provided that the magnetically attracting force of the solenoid 312** is represented by $F_{SV}$, the following expression is satisfied when the valve is open:

$$F_{SP} < Psmin \times S_1 + F_{SV}$$

Thus, a small driving force is sufficient to open the electromagnetic valve, so that the electromagnetic actuator can be reduced in size.

Figure 15:
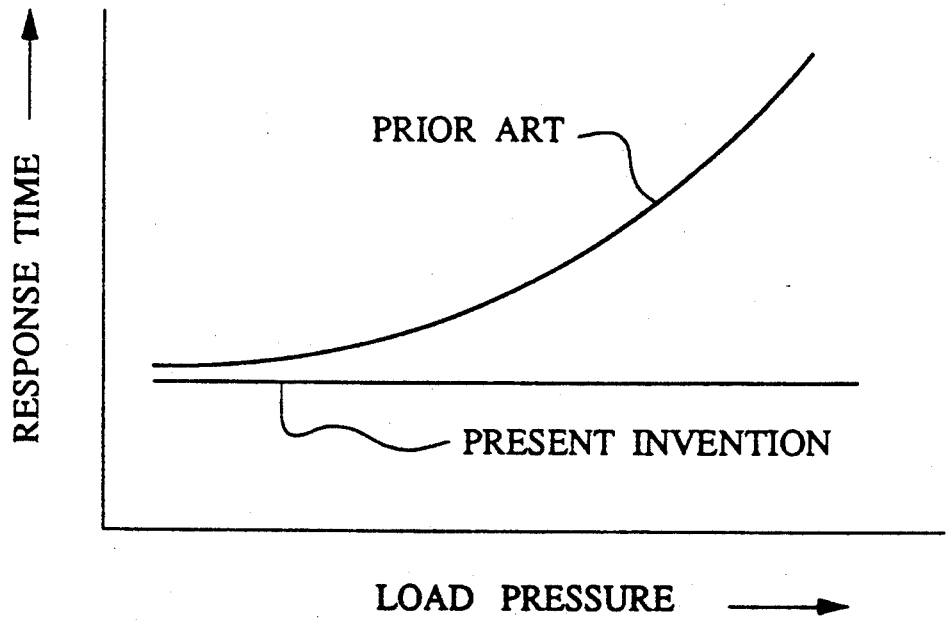
FIG. 15 is a view showing operating characteristics of the capacity control systems according to the prior art and the present invention.

Further, as shown in FIG. 15, compared with the conventional capacity control system, the capacity control system according to this embodiment of the invention operates without variations in the response time with changes in the load pressure, i.e. the response time is constant irrespectively of load pressure.

Therefore, the capacity control system according to this embodiment of the invention is capable of effecting delicate or fine control of the delivery quantity or capacity of the compressor.

What is claimed is:

1. In a variable capacity compressor including a suction chamber, a discharging space within which discharge pressure prevails, a control element for determining timing of start of compression of a refrigerant gas, said control element having a pressure-receiving portion, a low-pressure chamber within which prevails suction pressure acting on said pressure-receiving portion of said control element, urging means cooperating with said suction pressure for urging said control element toward a minimum capacity position thereof, a high-pressure chamber within which prevails control pressure acting on said pressure-receiving portion of said control element for urging said control element toward a maximum capacity position thereof, high pressure-introducing passage means for introducing said refrigerant gas from said discharging space into said high-pressure chamber to create said control pressure therein, said high pressure-introducing passage means having a restriction hole for restricting flow of said refrigerant gas, a passage for communicating said high-pressure chamber with said suction chamber, a valve body for opening and closing said passage, a plunger, a coiled spring urging said valve body in a valve-closing direction through said plunger, and an electromagnetic actuator for magnetically attracting said plunger in a valve-opening direction against the urging force of said coiled spring, the improvement wherein:

said valve body comprises a ball valve; and passageway means is provided for applying said control pressure to one end of said ball valve of said valve body in said valve-opening direction, and at the same time for applying said control pressure to another end of said ball valve of said valve body in said valve-closing direction.

2. A variable capacity compressor according to claim 1, wherein said plunger has a transverse through hole formed therein for introducing said control pressure thereinto such that said control pressure acts to urge said ball valve of said valve body in said valve-closing direction through said plunger.

* * * * *